US005829706A

United States Patent [19]

Schatton et al.

[11] Patent Number: 5,829,706

[45] Date of Patent: Nov. 3, 1998

[54] YARN END PREPARATION DEVICE FOR CHEESE-PRODUCING TEXTILE MACHINES

[75] Inventors: Siegfried Schatton; Ulrich Wirtz, both of Mönchengladbach, Germany

[73] Assignee: W. Schlafhorst AG & Co., Moenchengladbach, Germany

[21] Appl. No.: 963,252

[22] Filed: Nov. 3, 1997

Related U.S. Application Data

[63] Continuation of Ser. No. 774,350, Dec. 27, 1996, abandoned, which is a continuation of Ser. No. 484,524, Jun. 7, 1995, abandoned.

[30] Foreign Application Priority Data

Jun. 16, 1994 [DE] Germany ..... 44 20 979.7

[51] Int. Cl.[6] ..... B65H 67/08; B65H 54/22

[52] U.S. Cl. ..... 242/475.4; 57/22; 242/475.6

[58] Field of Search ..... 242/35.6 R, 475.4, 242/475.6; 57/22, 261, 263

[56] References Cited

U.S. PATENT DOCUMENTS

| | | | |
|---|---|---|---|
| 4,408,442 | 10/1983 | Rohner | 57/22 |
| 4,494,368 | 1/1985 | Mima | 57/22 |
| 4,608,815 | 9/1986 | Rohner et al. | 57/22 |
| 4,877,194 | 10/1989 | Matsui et al. | 242/35.6 R |
| 4,939,893 | 7/1990 | Fujiwara | 57/22 |
| 5,115,629 | 5/1992 | Zumfeld | 57/22 |
| 5,188,304 | 2/1993 | Colli et al. | 242/35.6 R |

FOREIGN PATENT DOCUMENTS

| | | |
|---|---|---|
| 2444973 | 4/1975 | Germany . |
| 4005752 | 8/1991 | Germany . |

OTHER PUBLICATIONS

"Kreuzspulautomat AUTOCONER ®238 mit Rundmagazin", Schlafhorst, pp. 1–31.

*Primary Examiner*—Michael Mansen
*Attorney, Agent, or Firm*—Herbert L. Lerner; Laurence A. Greenberg

[57] ABSTRACT

A yarn end preparation device for a cheese-producing textile machine includes at least one preparation nozzle having a mouth. A clamping device and a cutting device manipulate a yarn to be prepared for a subsequent operation. The cutting device is disposed in the immediate vicinity of the mouth of the at least one preparation nozzle. An additional loop former is also provided.

7 Claims, 5 Drawing Sheets

YARN END PREPARATION DEVICE FOR CHEESE-PRODUCING TEXTILE MACHINES

CROSS-REFERENCE TO RELATED APPLICATION

This application is a continuation of application Ser. No. 08/774,350, filed on Dec. 27, 1996 now abandoned, which was a continuation of application Ser. No. 08/484,524, filed Jun. 7, 1995, now abandoned.

BACKGROUND OF THE INVENTION

FIELD OF THE INVENTION

The invention relates to a yarn end preparation device for textile machines producing cheeses or cross-wound bobbins and having at least one preparation nozzle and one clamping and cutting device for manipulating a yarn to be prepared for a subsequent operation.

Such yarn end preparation devices have been described in combination with splicers, for instance in a brochure published by the firm Schlafhorst for its automatic cheese winder "AUTOCONER 238". In those splicers, two yarn ends that are to be joined together are first prepared by pneumatic opening of the yarn twist, in special small opening tubes. For preparation purposes, each of the yarn ends are aspirated into a small tube. Through the use of compressed air aimed at the end of the yarn, the yarn twist is undone and loose fibers are blown away, so that the result is a so-called opened yarn end with as many parallel fibers as possible, which are spliced pneumatically to the fibers of the other yarn end.

The appearance and quality of a spliced connection depends on the preparation of the yarn ends, among other factors. It is not until the yarn ends are optimally prepared that yarn joins are obtained having an appearance and strength which are not substantially distinguishable from the remainder of the yarn. For that reason, particular attention is paid to the preparation of the yarn ends. An optimal spliced connection can be attained, for instance, only if the yarn ends are prepared in a form and with a length that are adapted to the particular yarn parameters.

In the known splicers, a middle piece of the length of yarn moving past the intake opening of the preparation nozzle is engaged and aspirated as a loop into the preparation nozzle. As a rule, the aspiration is effected by blowing-in compressed air, which is aimed at the yarn end in order to open the yarn twist. The danger exists that the stream of compressed air which is intended to open the yarn twist will first meet the aspirated loop of yarn and blow fibers into the as yet unopened part of the yarn end, causing uneven opening of the yarn end. In other words, the point of the yarn end where the opening stream of compressed air strikes first can become thinner than the remaining fiber structure. Particularly in the region of the loop that is aspirated, the danger therefore exists that the fiber structure will be impaired, with a negative impact on the strength and appearance of the spliced connection.

With relatively stiff yarns, such as linen yarns, it is moreover possible that aspirating the yarn ends in loop form into the preparation nozzles, which are relatively small in diameter, will fail. In such a case, no preparation of the yarn ends is possible, and thus a durable spliced connection can be obtained only by additional, expensive provisions, such as wet splicing.

Splicers have therefore already been proposed in which aspiration of the yarn ends into the preparation nozzles by way of a loop of yarn is prevented.

Those splicers known from German Published, Non-Prosecuted Application DE 40 05 752 A1, corresponding to U.S. Pat. No. 5,115,629, have pivotably supported preparation nozzles, which are aimed in their outset position directly at the cutting tool for the upper or lower yarn. That means that the intake opening of the affected preparation nozzle is aimed at the point of the yarn at which it will be cut. When the cutting tool is put into operation, a flow of suction is simultaneously applied to the intake opening of the preparation nozzle. Since the end of the severed yarn to be prepared is immediately engaged by the suction flow and is aspirated with the cut surface leading into the preparation nozzle, it is assured that the preparation of the yarn end, or in other words the pneumatic opening of the yarn twist, progresses from the cut surface onward, as soon as the yarn end has been aspirated into the preparation nozzle. The loose fibers are engaged directly by the suction flow and carried away. They can no longer backup at the as yet unprepared yarn end and hinder the opening process, as can happen with a yarn loop. The opening of the yarn end in that apparatus purposefully takes place only at the length at which the yarn end is aspirated into the preparation nozzle and is exposed to the opening air stream. That known device, while it does perform satisfactorily, is relatively complicated and expensive in terms of its construction.

SUMMARY OF THE INVENTION

It is accordingly an object of the invention to provide a yarn end preparation device for cheese-producing textile machines, which overcomes the hereinafore-mentioned disadvantages of the heretofore-known devices of this general type.

With the foregoing and other objects in view there is provided, in accordance with the invention, a cheese-producing textile machine, comprising a yarn end preparation device including at least one preparation nozzle having a mouth; a clamping device and a cutting device for manipulating a yarn to be prepared for a subsequent operation, the cutting device being disposed in the immediate vicinity of the mouth of the at least one preparation nozzle; and an additional loop former.

The structure of the yarn end preparation device according to the invention results in a device that is very compact in construction and is satisfactory in function. By cutting the yarn ends in the immediate vicinity of the entry region of the preparation nozzles, it is assured that the yarn ends will be aspirated into the preparation nozzles with their cut surface first. The additional loop former assures that the yarn ends introduced into the small opening tubes will have the necessary length for optimal preparation. The device of the invention overall enables gentle, exact preparation of the yarn ends, which has a very favorable effect on the quality and appearance of the later splice.

In accordance with another feature of the invention, the loop former is constructed as a mechanical yarn tension device that can be placed in the course of the yarn to be processed.

In accordance with a further feature of the invention, the loop former is constructed as a pneumatic device, and a suction nozzle mouth region which, for instance, is constructed as a slit and extends in the yarn travel direction, enables the storage in loop form of even relatively stiff pieces of yarn.

In accordance with an added feature of the invention, if the yarn end preparation device according to the invention is used in combination with a pneumatic splicer, it is especially advantageous to construct the loop former as a rotary vane that can be deployed in a defined way. Through the use of a rotary vane of this kind, simultaneous, uniform cutting to length of the two yarn ends to be prepared can be assured in a simple manner.

In accordance with an additional feature of the invention, the rotary vane is swivelable into various positions. In an outset or initial position, the yarn driving pins of the rotary vane are positioned in such a way that the placement of the yarn ends into the splicer is not hindered in any way. In a yarn tensing position, the yarn ends, wrapped around retaining pins, are pulled out of the yarn storage devices exactly at a length that has been ascertained as being optimal for the ensuing yarn preparation or splicing connection.

In accordance with a concomitant feature of the invention, in a yarn adjusting position, which is located spatially between the outset position and the yarn tensing position, the yarn ends are advantageously swiveled approximately to the middle above the mouth of the preparation nozzles. In this position it is assured that the opening flow within the preparation nozzles can optimally process the yarn ends.

Other features which are considered as characteristic for the invention are set forth in the appended claims.

Although the invention is illustrated and described herein as embodied in a yarn end preparation device for cheese-producing textile machines, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
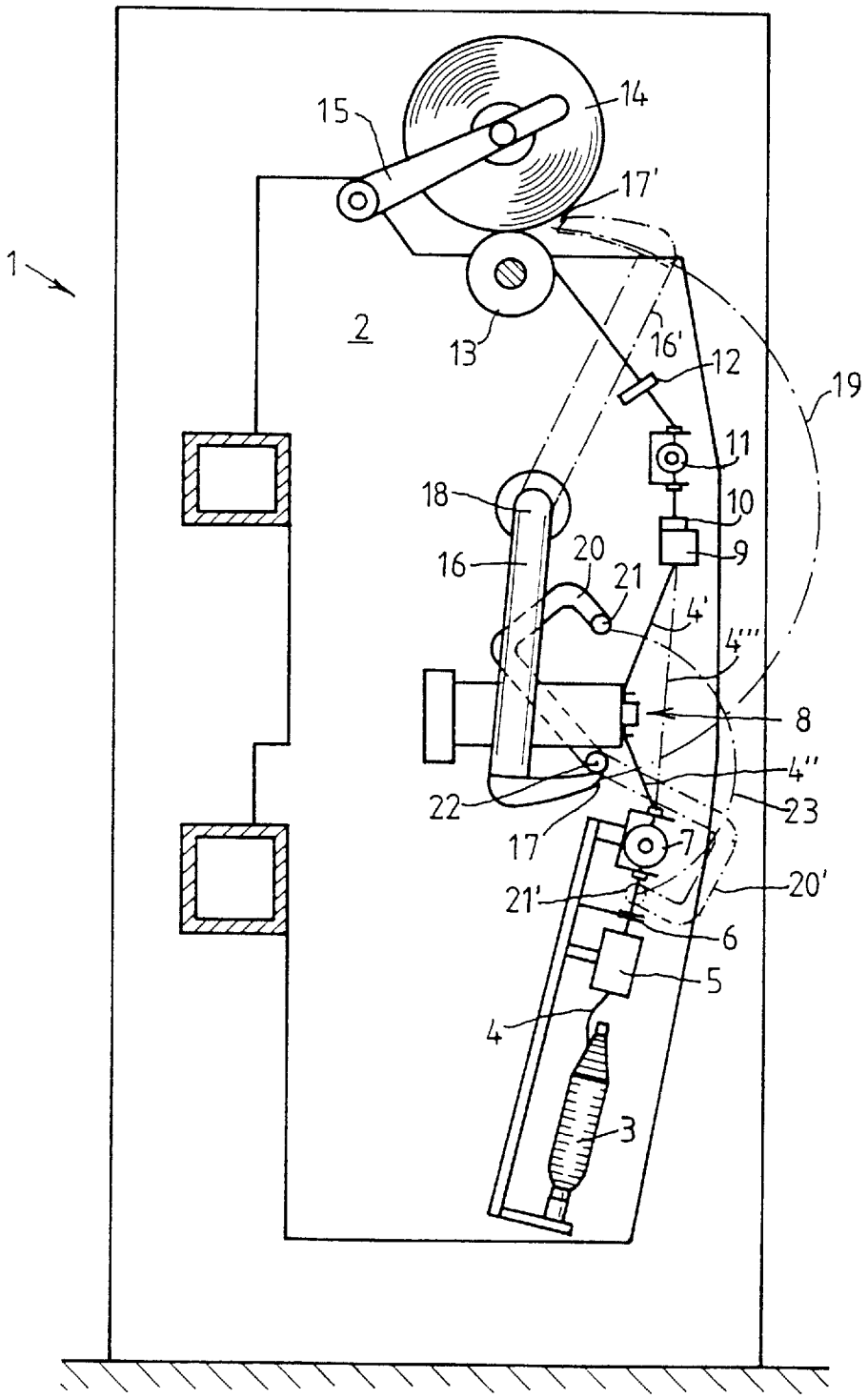
FIG. 1 is a diagrammatic, partly sectional, side-elevational view of a winding station disposed in a cheese winding machine, with a pneumatic splicer.

Referring now to the figures of the drawing in detail and first, particularly, to FIG. 1 thereof, there is seen a cheese winding machine 1 which is shown diagrammatically. Cheese winding machines of that kind have a number of winding stations 2 disposed one next to the other. The layout and function of such winding stations are known, and therefore the following explanation thereof is relatively brief.

A yarn 4 is drawn from a feed bobbin 3, which is in a feeding position, and extends through a balloon breaker 5 and a yarn eyelet 6 to the yarn tensioner 7. Disposed between the yarn tensioner 7 and the yarn monitor 9 is a splicer 8. While the yarn is being wound up, it takes the course marked by reference numeral 4'''. Yarn scissors 10 are associated with the yarn monitor 9 and sever the yarn whenever the yarn monitor 9 ascertains a departure from a predetermined standard. A paraffin applicator 11 is optionally located downstream of the yarn monitor 9 or the yarn scissors 10. From there, the yarn travels through a guide baffle 12 to a grooved drum 13, which simultaneously drives a cheese 14 and winds up the yarn in crosswise layers to form a cross-wound bobbin or cheese. The cheese 14 is carried in a creel 15.

In the present exemplary embodiment, the yarn travel between the feed bobbin 3 and the cheese 14 is to be interrupted. This kind of interruption in yarn travel always occurs whenever the yarn tears or is cut by the yarn scissors 10 following an irregularity. Another possible reason for interruption in the yarn travel is an imminent change of feed bobbin, or the reaching of the intended cheese diameter.

The joining of the yarn end of the cheese 14, or the yarn end of the yarn reserve of a newly mounted empty tube, to the yarn end of the feed bobbin 3, is carried out in the splicer 8. In order not to impede yarn travel during normal winding operation, the splicer 8 is set back from the yarn course 4'''. In order to establish a yarn connection, the yarn ends must therefore be placed in the splicer 8. To that end, a pivot nozzle 16 with a suction slit 17 is provided for an upper yarn 4'. In order to unwind the upper yarn 4' from the cheese 14, the pivot nozzle 16 pivots about a pivot joint 18 thereof to a position 16', which is shown in phantom. In this position of the pivot nozzle 16, the suction slit is in a position 17', near and in front of the surface of the cheese 14. The yarn end is aspirated by the suction slit from the cheese 14, which is driven counter to the winding direction. The pivot nozzle 16 thereupon swivels back into its outset or initial position. The aspirated yarn end, which is the upper yarn 4', is guided on a circular arc 19 and placed not only in the guide baffle 12, the paraffin applicator 11, the yarn scissors 10, and the yarn monitor 9, but also in the splicer 8. The lower yarn 4" is received by a suction tube 20 below the yarn tensioner 7. To that end, the suction tube swivels about a pivot joint 22 out of its position of repose shown in solid lines into a position 20' shown in phantom. An intake opening 21 is then in a position 21' in front of the yarn and aspirates the yarn from the yarn tensioner 7 as it opens. Next, the suction tube 20 swivels about the pivot joint 22 along an arc 23 back into its outset or initial position. In the process, the lower yarn 4" is placed into the opened yarn tensioner 7 and the splicer 8.

Figure 2:
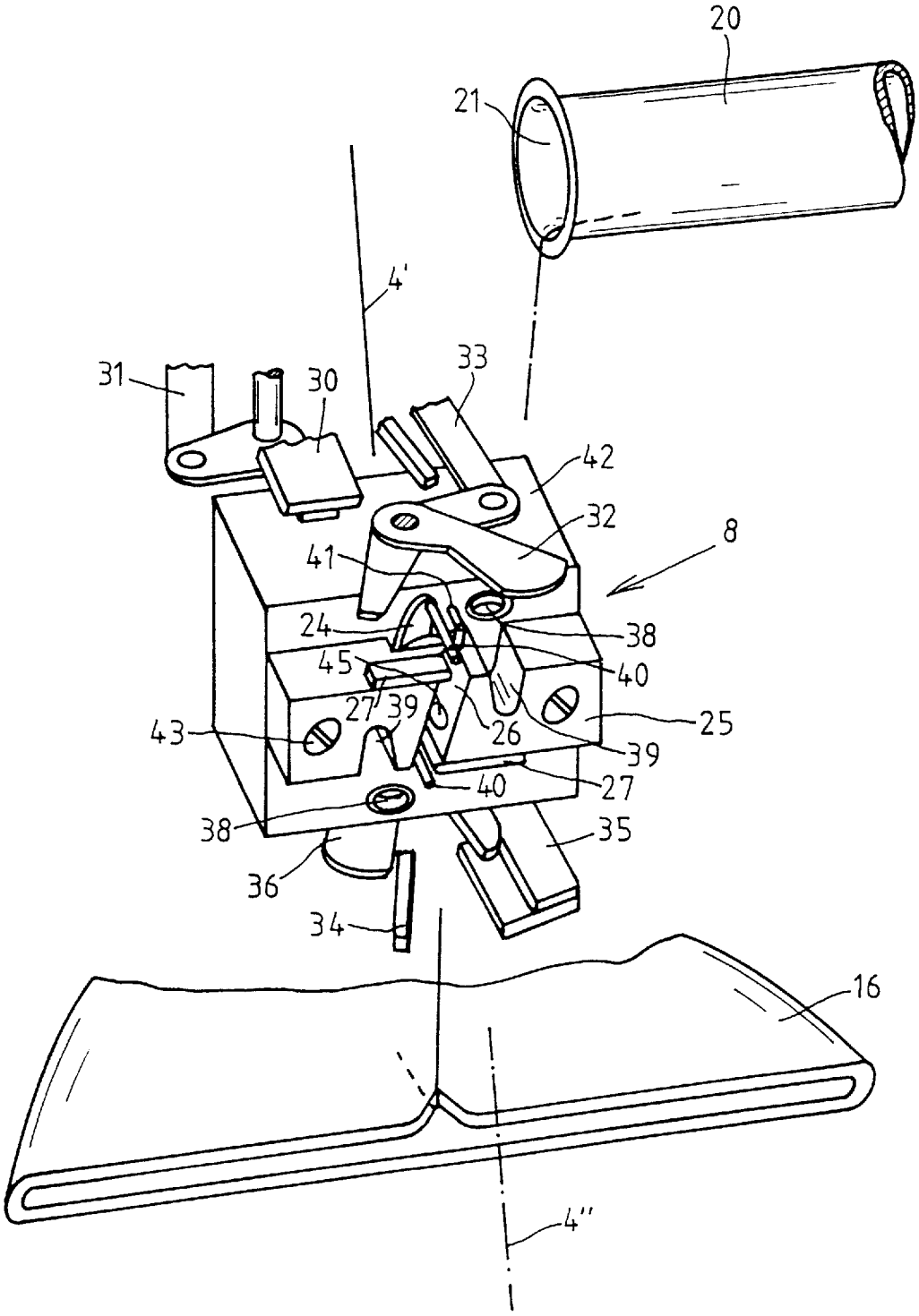
FIG. 2 is an enlarged, fragmentary, perspective view of the splicer according to the invention.

In FIG. 2, the yarn splicer 8 and the device according to the invention for preparing the yarn ends, are shown in perspective.

As can be seen, the splicer 8 has a splicer head or splicing prism 25, which is secured to an air distributor block 42 through screw bolts 43 and has a splicer channel 26. Preparation nozzles 38 that are disposed above and below the splicer prism 25 are formed in the air distributor block 42. At least one splicing air connection 45 discharges as usual into the splicing channel 26. Respective yarn guide baffles 27 are disposed next to the splicing channel 26. The yarn guide baffles 27 work in combination with similar yarn guide baffles 28, which are not shown in FIG. 2 for the sake of simplicity, to reinforce the respective placement of the yarn ends 4' and 4" into the splicer by the swivel nozzle 16 and the suction tube 20. The preparation nozzles 38 are disposed in inclined fashion in the air distributor block 42. In other words, entry regions of the preparation nozzles 38 are located in the immediate vicinity of respective cutting devices 32 and 36 and are aimed at them. Yarn clamping devices 30, 34, which are triggerable through actuating mechanisms 31, 35, as usual are provided next to the cutting devices. The cutting devices 32, 36 may be actuated through similar actuating mechanism 33.

Figure 3:
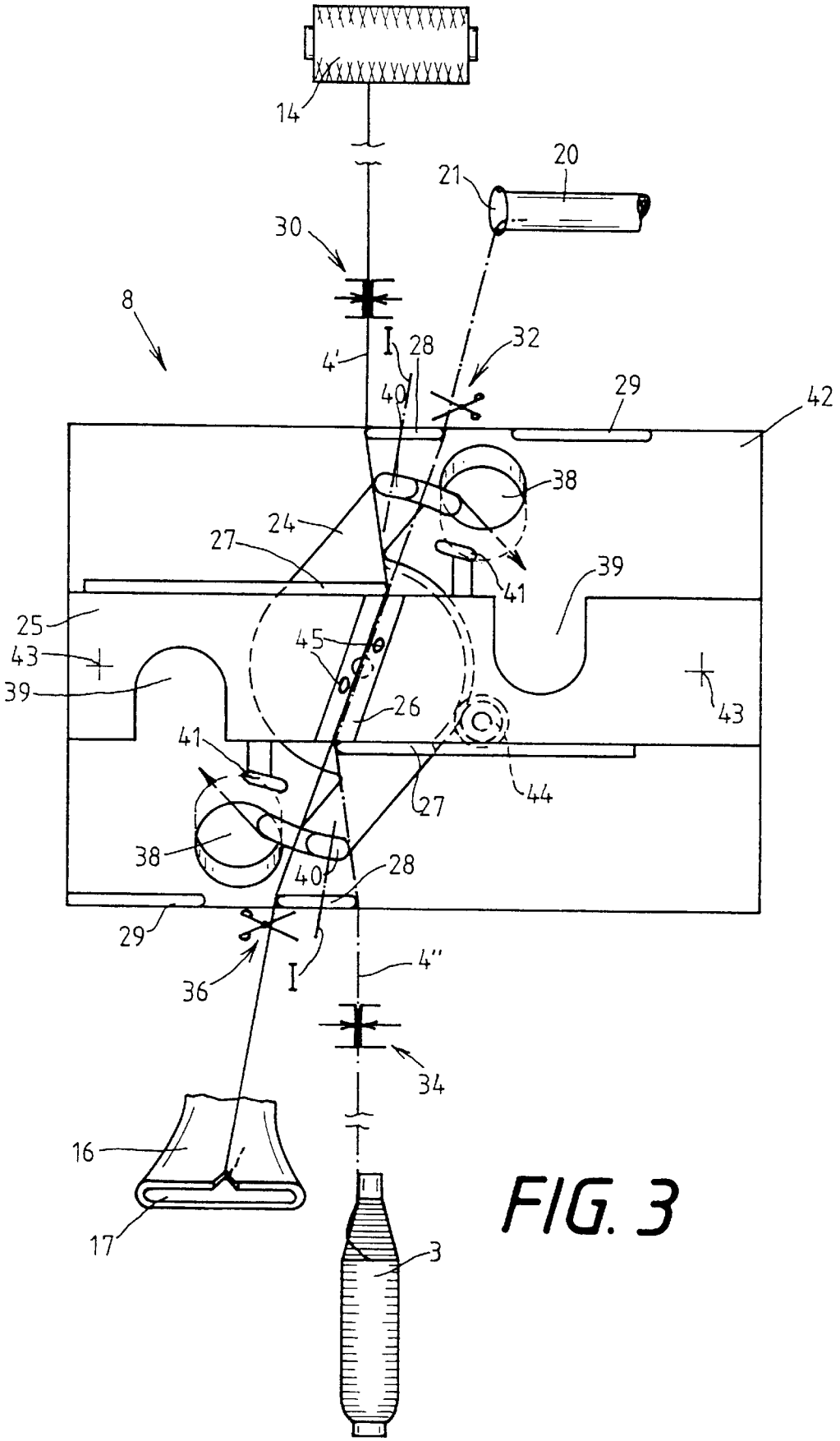
FIG. 3 is a diagrammatic perspective view illustrating a first phase in yarn end preparation.
Figure 4:
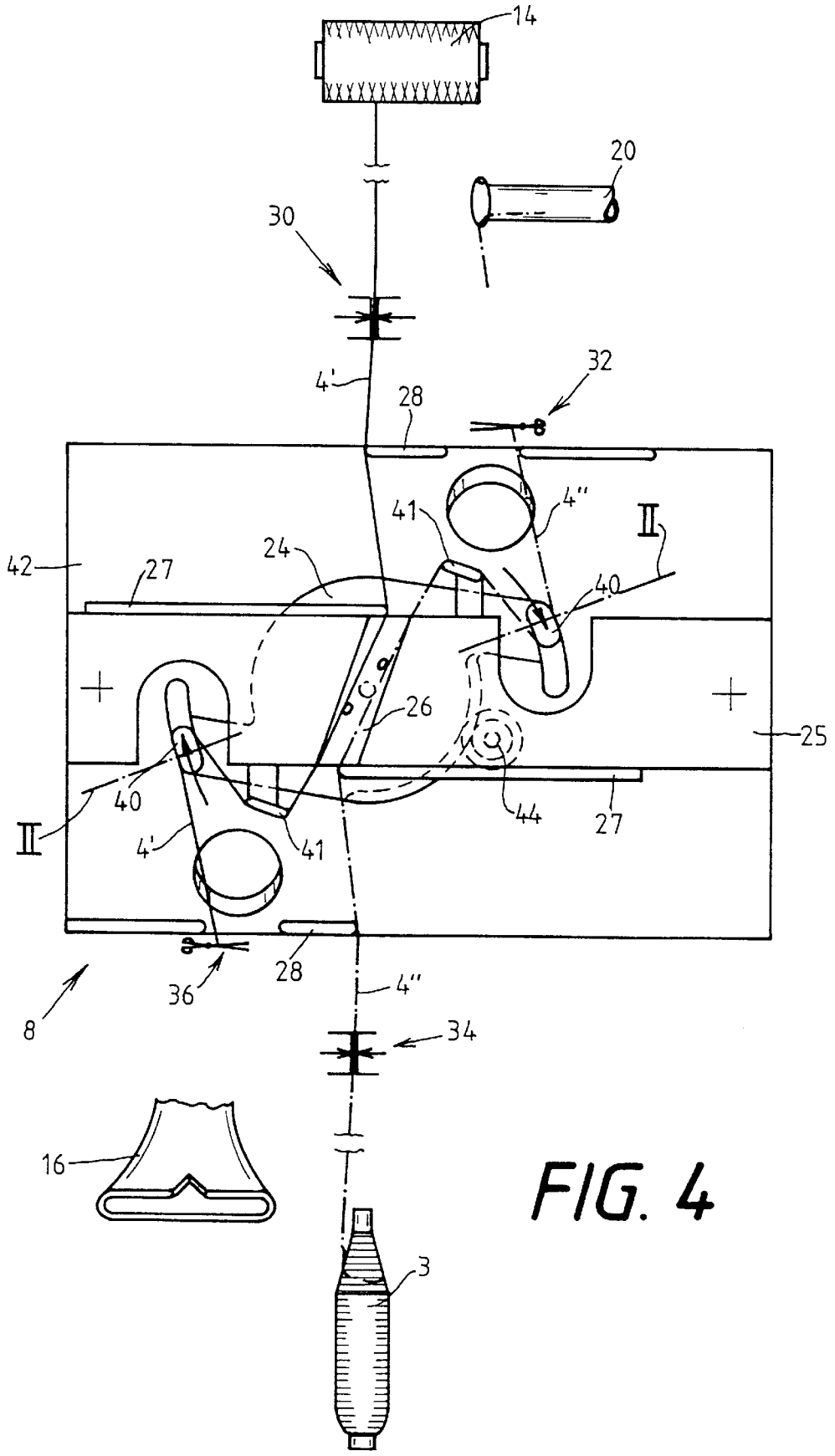
FIG. 4 is a diagrammatic perspective view illustrating a second phase.
Figure 5:
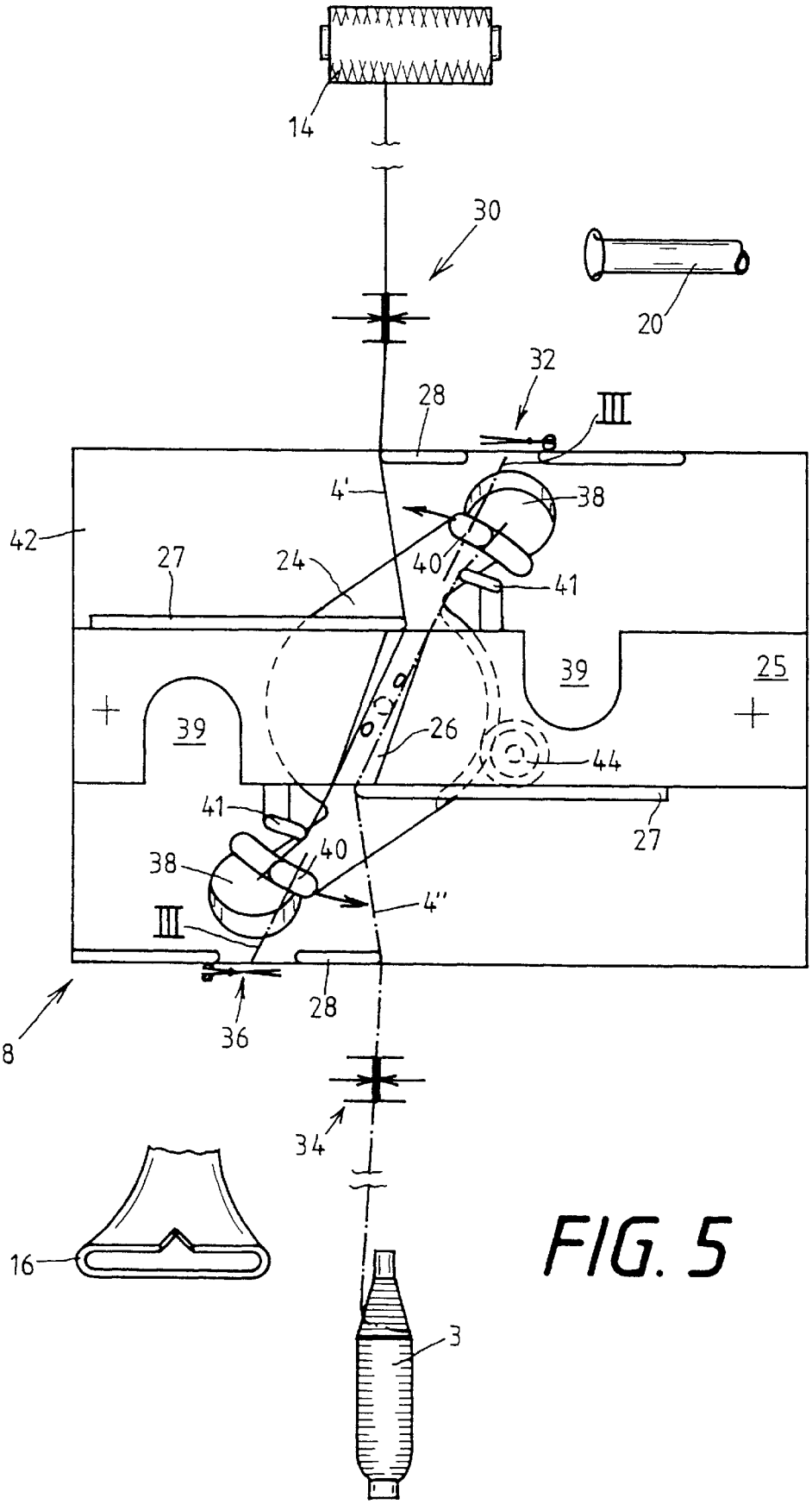
FIG. 5 is a diagrammatic perspective view illustrating a third phase.

An additional loop former in the form of a rotary vane 24, that can be acted upon in a defined fashion through a drive configuration 44 which is shown in FIGS. 3–5, is disposed and pivotably supported in the air distributor block 42, below the splicer head 25. When the rotary vane 24 swivels out of an outset or initial first position I shown in FIG. 3, into a yarn tensing second position II shown in FIG. 4, driving pins 40 of the rotary vane 24 sweep over retaining pins 41, which are secured above and below the splicer prism 25. In a final position, the driving pins 40 enter into recesses 39 of the splicer prism.

The function of the apparatus according to the invention will be described below in conjunction with FIGS. 3–5.

FIG. 3 shows a situation in which the yarn ends have already been placed in the splicer 8, but they have not yet been prepared. In other words, the swivel nozzle 16 has received the upper yarn 4' at the surface of the cheese 14 with its suction slit 17 and has swiveled into the lower position shown while carrying the upper yarn with it. In this swiveling motion the suction slit 17 has described the circular arc 19 suggested in FIG. 1, as already described above. The upper yarn 4', guided by guide baffles 27, 28, has been placed into the opened upper yarn clamp 30, the splicing channel 26, and the likewise open lower yarn cutting device 36.

The lower yarn 4", which begins at the feed bobbin 3, has been correspondingly placed into the opened lower yarn clamp 34, the splicing channel 26 and the open upper yarn cutting device 32 by the suction tube 20, that is swiveling upward along the arc 23.

After the closure of the yarn clamping devices 30 and 34, the additional loop former or rotary vane 24, which until then has been in its outset position I, is acted upon clockwise through the drive configuration 44. The yarn driving pins 40 of the rotary vane 24 intersect the course of the upper yarn 4' and the lower yarn 4" in the process and pull the yarns around the retaining pins 41 secured in the region of the splicing prism 25, as suggested in FIG. 4. The driving pins 40 of the rotary vane, which enter the recesses 39 of the splicing prism 25, thereby purposefully pull the yarn ends 4' and 4" out of these yarn laying devices counter to a suction which is present in both the swivel nozzle 16 and the suction tube 20, so that finally the yarn ends 4', 4" assume a length that is optimal for the ensuing preparation. In the yarn tension position II of the rotary vane 24, the yarn ends 4' and 4" follow a course between the associated cutting devices and the applicable driving pins in which they at least partially span the mouth of the preparation nozzles 38 that are subject to suction.

Next, by actuation of the cutting device 32, the lower yarn 4" that is fixed in the lower yarn clamp 34 is cut to the predetermined length. The leftover yarn is removed through the suction tube 20. In a similar way, the upper yarn 4' that is fixed in the upper yarn clamp 30 is cut to length as well. Since at the moment that the cutting devices 32 and 36 are actuated the preparation nozzles 38 are already acted upon by suction, the yarn ends are aspirated without delay, with their cut surface leading, into the preparation nozzles 38. The inward aspiration of the yarn ends is especially effective since the preparation nozzles 38 are disposed in such a way in the distributor block 42 of the splicer 8 that they are inclined toward the cutting devices 32, 36.

The rotary vane thereupon swivels back into its yarn adjusting third position III shown in FIG. 5. In this yarn adjusting position III, the yarn ends 4' and 4" are positioned approximately in the middle above the mouth of the preparation nozzles 38, which enables satisfactory preparation of the yarn ends by the air stream applied in the preparation nozzles 38. When the rotary vane 24 swivels back from the yarn tensing position II to the yarn adjusting position III, the cut ends of the yarn are aspirated purposefully into the small opening tubes 38, with their cut surface leading. This means that the length of the opening region of the yarn ends is adjustable by way of a variable angular position of the rotary vane 24 in the various functional positions (I, II, III).

The thus-prepared yarn ends 4' and 4" are then drawn out of the preparation nozzles by a so-called feeder into the splicing channel 26 of the splicing prism 25, where they are positioned parallel to one another. This occurs in a manner which is known and is therefore not described in further detail herein. The slightly overlapping ends of the yarn are then pneumatically spliced by a surge of compressed air. The cheese 14 is thus again continuously joined to the feed bobbin 3 and the winding process can be continued.

Although the yarn end preparation device according to the invention has been described above in connection with pneumatic splicer devices, of the kind preferably used in automatic cheese winders, it is expressly indicated that the use of such yarn end preparation devices is also advantageous in connection with open-end spinning machines. In such textile machines as well, it is known and usual for the yarn ends to be carefully prepared in suitable preparation nozzles before spinning is restarted.

We claim:

1. A yarn end preparation device of a cheese-producing textile machine, comprising:

at least one preparation nozzle having a mouth;

a clamping device and a cutting device for manipulating a yarn to be prepared for a subsequent operation, said cutting device being disposed immediately adjacent said mouth of said at least one preparation nozzle; and loop former means adjacent said at least one preparation nozzle for positioning the yarn during a preparation process, said loop former means having arms engaging a free yarn end cut with said cutting device and positioning the free yarn end in the immediate vicinity of said mouth of said at least one preparation nozzle, for positioning the free yarn end substantially in a middle of and spaced from an edge of said mouth, and for introducing the free yarn end into said mouth of said at least one preparation nozzle.

2. The device according to claim 1, wherein said loop former means is a mechanical yarn tension device intersecting travel of the yarn to be prepared.

3. The device according to claim 1, wherein said loop former means is a rotary vane to be triggered in a defined manner.

4. The device according to claim 1, wherein said loop former is a rotatably supported rotary vane, and including a drive configuration for swiveling said rotary vane into various functional positions.

5. The device according to claim 4, wherein said functional positions of said rotary vane include a first functional position forming a starting position for placing a yarn end section with the free yarn end into the splicer, a second functional position being a yarn tensing position for adjusting an optimal yarn end section length, and a third functional position located between said first and second positions being a yarn adjustment position for preparing the yarn end section in said at least one preparation nozzle.

6. The device according to claim 5, wherein said at least one preparation nozzle is a small opening tube, and the yarn end section being cut to length in said second functional position of said rotary vane enter with a cut surface leading into said small opening tube upon pivoting of said rotary vane back into said third functional position.

7. The device according to claim 1, wherein said at least one preparation nozzle is a small opening tube, said loop former means is a rotary vane being selectively positionable in a yarn tensing position and a yarn adjusting position, and the yarn has an opening region with a length entering into said small opening tube defined by a difference in a yarn loop length when said rotary vane is in the yarn tensing position and in the yarn adjusting position, respectively.

* * * * *